US010502240B2

(12) United States Patent
Slattery et al.

(10) Patent No.: US 10,502,240 B2
(45) Date of Patent: Dec. 10, 2019

(54) OPEN CENTER CONTROL VALVE

(71) Applicant: Parker-Hannifin Corporation, Cleveland, OH (US)

(72) Inventors: Brian Slattery, Hicksville, OH (US); Christopher J. Webber, North Royalton, OH (US); Bipin Kashid, Strongsville, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 16/401,276

(22) Filed: May 2, 2019

(65) Prior Publication Data

US 2019/0257325 A1 Aug. 22, 2019

Related U.S. Application Data

(63) Continuation of application No. 15/897,412, filed on Feb. 15, 2018, now Pat. No. 10,323,659.

(60) Provisional application No. 62/506,751, filed on May 16, 2017.

(51) Int. Cl.

| | |
|---|---|
| ***F15B 13/02*** | (2006.01) |
| ***F15B 13/08*** | (2006.01) |
| ***F15B 13/043*** | (2006.01) |
| ***F15B 13/04*** | (2006.01) |

(52) U.S. Cl.

CPC ..... *F15B 13/0842* (2013.01); *F15B 13/0402* (2013.01); *F15B 13/043* (2013.01); *F15B 13/0814* (2013.01); *F15B 13/0835* (2013.01)

(58) Field of Classification Search

CPC ..... F15B 13/0842; F15B 13/0402; F15B 13/043; F15B 13/0814; F15B 13/0835

USPC ..... 137/596, 625.28, 625.34, 269; 91/418, 91/433, 454

See application file for complete search history.

(56) References Cited

U.S. PATENT DOCUMENTS

| | | | | |
|---|---|---|---|---|
| 2,651,324 | A | 9/1953 | Hodgson et al. | |
| 2,745,433 | A | 5/1956 | Schneider et al. | |
| 2,373,762 | A | 2/1959 | Tennis | |
| 3,216,443 | A | 11/1965 | Schmiel | |
| 3,216,446 | A | 11/1965 | Schmiel | |
| 3,718,159 | A | 2/1973 | Tennis | |
| 3,757,823 | A | 9/1973 | Knutson | |
| 3,771,558 | A | 11/1973 | Ailshie | |
| 3,939,870 | A * | 2/1976 | Guigliano | F15B 13/0402 137/624.27 |

(Continued)

*Primary Examiner* — Minh Q Le

(74) *Attorney, Agent, or Firm* — McDonnell Boehnen Hulbert & Berghoff LLP

(57) ABSTRACT

An example valve section includes: a housing having: (i) a longitudinal bore, (ii) a first and second workport passages configured to be fluidly coupled to an actuator, (iii) a first and second return passages, (iv) an open-center passage configured to be fluidly coupled to a source of fluid, and (v) a supply passage disposed between the first and second workport passages. The valve section also includes a spool movable in the longitudinal bore to shift between: (i) a neutral position that allows the open-center passage to permit fluid flow therethrough, and (ii) a shifted position that allows fluid to be diverted from the open-center passage to the supply passage, and connects the supply passage to either the first or second workport passage while connecting the other workport passage to a corresponding return passage of the first and second return passages.

20 Claims, 10 Drawing Sheets

(56) References Cited

U.S. PATENT DOCUMENTS

| | | | | |
|---|---|---|---|---|
| 3,967,640 | A | 7/1976 | Bianchetta | |
| 4,061,159 | A | 12/1977 | Brakel | |
| 4,139,021 | A | 2/1979 | Ailshie et al. | |
| 4,167,197 | A | 9/1979 | Maki et al. | |
| 4,198,822 | A | 4/1980 | Miller | |
| 4,463,819 | A | 8/1984 | Becker et al. | |
| 5,394,903 | A | 3/1995 | Tominaga | |
| 5,771,918 | A * | 6/1998 | Fukano | F15B 13/0817 137/269 |
| 5,915,409 | A | 6/1999 | Kaneko et al. | |
| 5,996,623 | A * | 12/1999 | Omberg | F15B 13/0402 137/596.13 |
| 6,152,172 | A | 11/2000 | Christianson et al. | |
| 6,269,733 | B1 | 8/2001 | Reust | |
| 6,364,280 | B1 * | 4/2002 | Stach | F15B 13/0402 137/625.69 |
| 6,408,876 | B1 | 6/2002 | Nishimura et al. | |
| 6,470,912 | B1 * | 10/2002 | Haynes | F15B 13/0402 137/596 |
| 6,505,645 | B1 | 1/2003 | Pack et al. | |
| 6,877,417 | B2 | 4/2005 | Shimada | |
| 6,964,281 | B2 | 11/2005 | Pieper | |
| 7,021,332 | B2 | 4/2006 | Greenwood et al. | |
| 8,899,034 | B2 | 12/2014 | Ballweg et al. | |
| 9,482,352 | B2 | 11/2016 | West et al. | |
| 10,024,443 | B2 | 7/2018 | Sensabaugh et al. | |
| 2008/0202608 | A1 * | 8/2008 | Tschida | F15B 13/0402 137/554 |
| 2008/0223026 | A1 | 9/2008 | Schuh et al. | |
| 2011/0132473 | A1 | 6/2011 | Rinaldi | |
| 2012/0199770 | A1 | 8/2012 | Alessandro | |
| 2015/0059332 | A1 * | 3/2015 | Hashimoto | F15B 11/16 60/468 |
| 2017/0307096 | A1 * | 10/2017 | Janecke | F16K 11/10 |
| 2017/0350097 | A1 * | 12/2017 | Kang | F15B 13/02 |

* cited by examiner

OPEN CENTER CONTROL VALVE

CROSS REFERENCE TO RELATED APPLICATION

The present application is a continuation of U.S. patent application Ser. No. 15/897,412, filed on Feb. 15, 2018, and entitled "Open Center Control Valve," which claims priority to U.S. Provisional patent application Ser. No. 62/506,751, filed on May 16, 2017, and entitled "Open Center Control Valve," the entire contents of all of which are herein incorporated by reference as if fully set forth in this description.

BACKGROUND

Multiple-spool control valves generally comprise a plurality of directional control valve sections, each provided with a shiftable control spool controlling fluid flow to one or more hydraulic actuators. The valve sections are sandwiched between inlet and outlet end sections having ports connectable with a source of fluid and a low pressure reservoir. Open-center type assemblies permit continuous open-center flow transversely through the valve assembly from the inlet to the outlet when all the spools are in neutral non-operative positions. Upon shifting a control spool to divert the fluid to actuate the associated actuator, the spool variably restricts or shuts off the open-center flow.

Pressure drop across a valve assembly as fluid flows through the valve is associated with power loss. An improved design that reduces pressure drop may thus be desirable.

In examples, the valve assembly may be placed on a vehicle to control various actuators of the vehicle. Various hoses and plumbing components are connected to the various valve sections. Orientation of the workports of the valve assembly that are connected to the actuators affects the complexity of plumbing and thus affects reliability and failure rates. Thus, orientating the workports in a particular direction may reduce complexity of plumbing. However, such change in orientation of workports affects layout of fluid passages and coring design inside the valve sections.

Another concern with spool valves involves spool bore distortion. Valve sections may have longitudinal bores therein to accommodate spools that are shiftable in the bores. When high pressure fluid flows through the internal passages of the valve section, the longitudinal bore that accommodates the spool may be distorted under pressure. Such distortion may cause the spool to bind and may thus hinder actuation of the spool. It may thus be desirable to design the valve sections and layout of internal passages in a manner that reduces impact of high pressure fluid on internal walls of the valve section so as to reduce distortion.

In examples, valve sections are equipped with pressure relief valves that are normally closed, but are configured to open a fluid path to a reservoir when pressure level associated with a given workport exceeds a predetermined pressure value. In this manner, the actuators controlled by the valve assembly are protected from high pressure levels that could cause damage. In examples, a respective relief valve is associated with each workport. For instance, if there are two workports in each valve section communicating fluid to and from respective chambers of a hydraulic actuator, two relief valves are installed in the valve, one relief valve for each workport. Having a relief valve for each workport is costly, and it may thus be desirable to have a single relief valve protecting both chambers of the actuators.

SUMMARY

The present disclosure describes implementations that relate to an open center control valve. In a first example implementation, the present disclosure describes a valve section. The valve section includes a housing having: (i) a longitudinal bore, (ii) a first and second workport passages intercepting the longitudinal bore and configured to be fluidly coupled to an actuator, (iii) a first and second return passages intercepting the longitudinal bore, where the first and second workport passages are disposed between the first and second return passages, (iv) an open-center passage intercepting the longitudinal bore and configured to be fluidly coupled to a source of fluid, and (v) a supply passage intercepting the longitudinal bore and disposed between the first and second workport passages, where the supply passage, the first and second workport passages, and the first and second return passages are disposed on one side of the open-center passage. The valve section also includes a spool movable in the longitudinal bore to shift between: (i) a neutral position that allows the open-center passage to permit fluid flow therethrough, and (ii) a shifted position that allows fluid to be diverted from the open-center passage to the supply passage, and connects the supply passage to either the first or second workport passage while connecting the other workport passage to a corresponding return passage of the first and second return passages.

In a second example implementation, the present disclosure describes a valve assembly. The valve assembly includes a first end section having: (i) an inlet port configured to be fluidly coupled to a source of fluid, and (ii) a first outlet port configured to be fluidly coupled to a reservoir. The valve assembly also includes a second end section having a second outlet port configured to be fluidly coupled to the reservoir. The valve assembly further includes a plurality of valve sections positioned between the first end section and the second end section. Each valve section of the plurality of valve sections includes a housing having: (i) a longitudinal bore, (ii) a first and second workport passages intercepting the longitudinal bore and configured to be fluidly coupled to an actuator, (iii) a first and second return passages intercepting the longitudinal bore and connected to the first outlet port and the second outlet port, where the first and second workport passages are disposed between the first and second return passages, (iv) an open-center passage intercepting the longitudinal bore and configured to be connected to the inlet port of the first end section, and (v) a supply passage intercepting the longitudinal bore and disposed between the first and second workport passages, where the supply passage, the first and second workport passages, and the first and second return passages are disposed on one side of the open-center passage. Each valve section of the plurality of valve sections also includes a spool movable in the longitudinal bore to shift between: (i) a neutral position that allows the open-center passage to permit fluid flow from the inlet port through the open-center passage, and (ii) a shifted position that allows fluid to be diverted from the open-center passage to the supply passage, and connects the supply passage to either the first or second workport passage while connecting the other workport passage to a corresponding return passage of the first and second return passages.

In a third example implementation, the present disclosure describes a hydraulic system. The hydraulic system includes: (i) a hydraulic actuator having a first chamber and a second chamber; (ii) a source of fluid; (iii) a reservoir; and (iv) a valve assembly. The valve assembly includes: (i) a first end section having an inlet port configured to be fluidly coupled to the source of fluid and a first outlet port configured to be fluidly coupled to the reservoir, (ii) a second end section having a second outlet port configured to be fluidly coupled to the reservoir, and (iii) a plurality of valve sections positioned between the first end section and the second end section. Each valve section of the plurality of valve sections includes a housing having: (i) a longitudinal bore, (ii) a first and second workport passages intercepting the longitudinal bore and configured to be fluidly coupled respectively to the first and second chambers of the hydraulic actuator, (iii) a first and second return passages intercepting the longitudinal bore and connected to the first outlet port and the second outlet port, where the first and second workport passages are disposed between the first and second return passages, (iv) an open-center passage intercepting the longitudinal bore and configured to be connected to the inlet port, and (v) a supply passage intercepting the longitudinal bore and disposed between the first and second workport passages, where the supply passage, the first and second workport passages, and the first and second return passages are disposed on one side of the open-center passage. Each valve section of the plurality of valve sections also includes a spool movable in the longitudinal bore to shift between: (i) a neutral position that allows the open-center passage to permit fluid flow from the inlet port through the open-center passage, and (ii) a shifted position that allows fluid to be diverted from the open-center passage to the supply passage, and connects the supply passage to either the first or second workport passage while connecting the other workport passage to a corresponding return passage of the first and second return passages.

The foregoing summary is illustrative only and is not intended to be in any way limiting. In addition to the illustrative aspects, implementations, and features described above, further aspects, implementations, and features will become apparent by reference to the figures and the following detailed description.

DETAILED DESCRIPTION

Disclosed herein are systems and valves that, among other features, reduce pressure drop across a valve, enable orientating workports in a manner that reduces complexity of plumbing associated with the valve, reduce spool bore distortion, and enable designing the valve with a single pressure relief valve for each valve section protecting both chambers of an actuator.

Figure 1A:
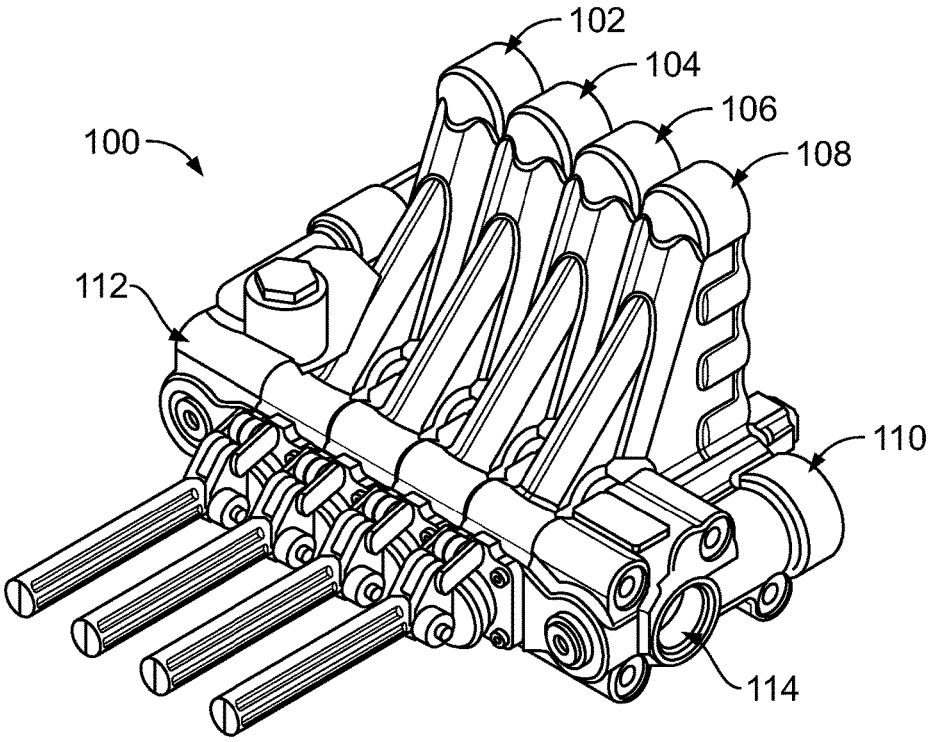
FIG. 1A illustrates a perspective view of a valve assembly of a multiple-spool sectional control valve, in accordance with an example implementation.

FIG. 1A illustrates a perspective view of a valve assembly 100 of a multiple-spool sectional control valve, in accordance with an example implementation. As an example for illustration, the valve assembly 100 includes four control valve sections 102, 104, 106, and 108 positioned adjacent to one another between a first end section 110 (e.g., an inlet port plate section) and a second end section 112 (e.g., an outlet port plate section). The valve assembly 100 may have a greater or fewer number of valve sections based on an application and a number of actuators controlled by the valve assembly 100.

Figure 1B:
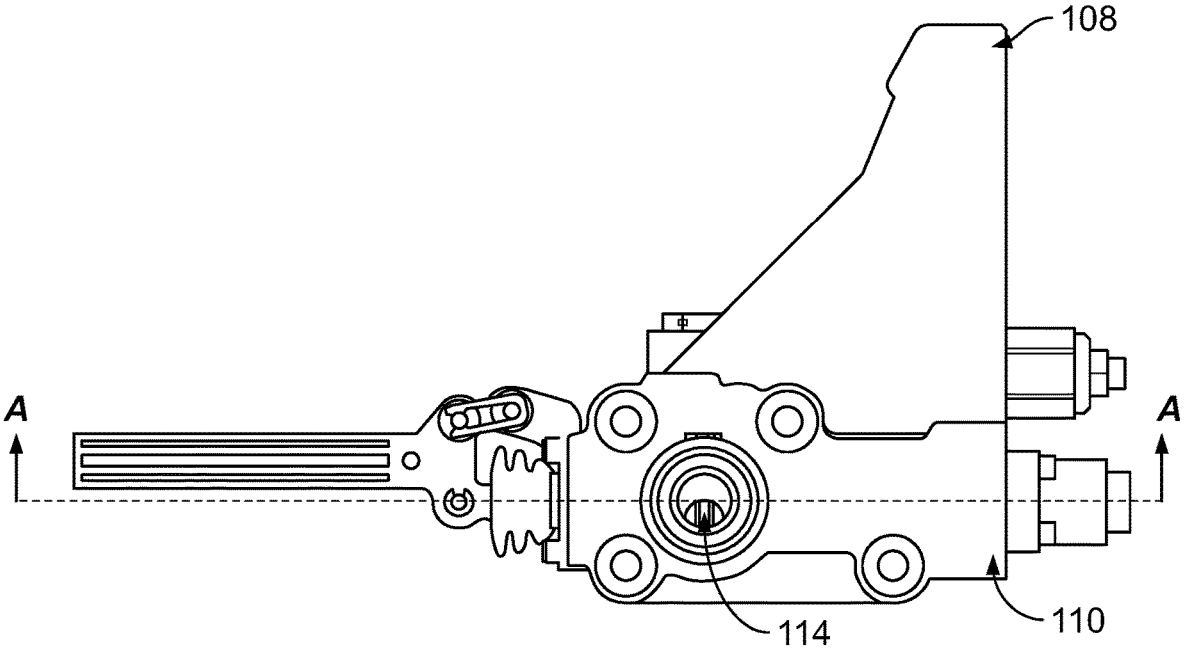
FIG. 1B illustrates a side view of the valve assembly shown in FIG. 1A, in accordance with an example implementation.
Figure 1C:
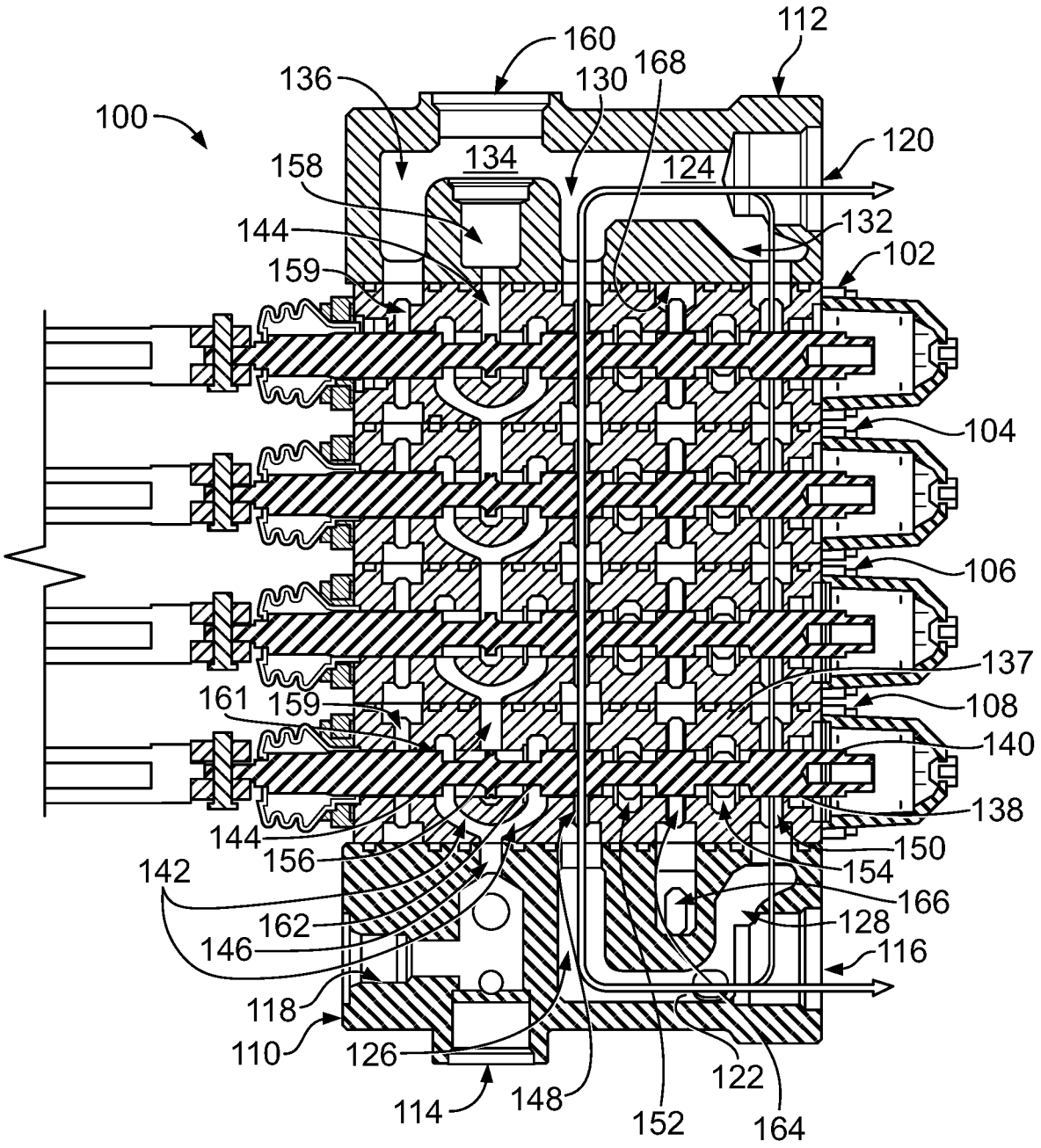
FIG. 1C illustrates a cross section of the valve assembly shown in FIG. 1A, in accordance with an example implementation.

FIG. 1B illustrates a side view of the valve assembly 100, and FIG. 1C illustrates cross section A-A depicted in FIG. 1B of the valve assembly 100, in accordance with an example implementation. As shown in FIG. 1C, the first end section 110 has an inlet port 114 that is configured to be fluidly coupled to a source of fluid such as a pump, an accumulator, etc. The first end section 110 also has a first outlet port 116 that is configured to be fluidly coupled to a tank or reservoir having low pressure fluid. The first end section 110 also has a bore 118 configured to receive a master relief valve (not shown). The master relief valve is configured to remain closed as long as fluid provided by the source through the inlet port 114 is below a predetermined threshold pressure level. If the pressure level exceeds the predetermined threshold pressure level, the master relief valve opens to provide a path for high pressure fluid to the reservoir to protect the valve assembly 100 from the high pressure level and prevent damage.

The second end section 112 includes a second outlet port 120 that is also configured to be fluidly coupled to the tank or reservoir having the low pressure fluid. Further, each of the end sections 110 and 112 includes exhaust fluid passages having longitudinally extending bight portions 122 and 124, respectively connecting with transverse leg portions 126, 128, 130, and 132 located at opposite sides of the end sections 110 and 112. The end section 112 also includes another bight portion 134 that connects the bight portion 124 and leg portion 130 to another leg portion 136. The outlet port 116 is connected to the bight 122 and leg portion 128 of the end section 110, whereas the outlet port 120 is connected to the bight portion 124 and the leg portion 132.

The valve section 108 is described next. The other valve sections 102-106 are similar and therefore reference numbers assigned to features of the valve section 108 can also be used to refer to corresponding features of the valve section 102-106.

The valve section 108 includes a housing 137 that defines therein a longitudinal bore 138 configured to receive a spool 140 that is axially movable in the longitudinal bore 138. The housing 137 includes an open-center passage intercepting the longitudinal bore 138 and including a dual-wing passage 142 straddling a center passage 144. The open-center passage, and specifically the dual wing passage 142, is connected to an inlet passage 146 disposed in the end section 110 and connected to the inlet port 114.

The housing 137 further includes a transversely extending first return passage 148 intercepting the longitudinal bore 138 and a transversely extending second return passage 150 intercepting the longitudinal bore 138. The first return passage 148 is annular, and therefore fluid traversing the first return passage 148 flows about the spool 140 and continues to an adjacent valve section. Respective first return passages 148 of the valve sections 102-108 form a first fluid path that connects the leg portion 126 of the end section 110 to the leg portion 130 of the end section 112. Similarly, respective second return passages 150 of the valve sections 102-108 form a second fluid path that connects the leg portion 128 of the end section 110 to the leg portion 132 of the end section 112. With this configuration, the bight 122, the leg portion 126, the first fluid path formed by the respective first return passages 148, the leg portion 130, the bight 124, the leg portion 132, the second fluid path formed by the respective second return passages 150, and the leg portion 128 form a race-track fluid path for fluid received at the inlet port 114 as described below. The race-track fluid path is illustrates by thick lines tracing the fluid path as shown in FIG. 1C.

The housing 137 further includes a transversely extending first workport passage 152 intercepting the longitudinal bore 138 and a transversely extending second workport passage 154 intercepting the longitudinal bore 138. The workport passages 152 and 154 are connected via respective ducts to workports configured to be fluidly coupled to an actuator controlled by the valve section 108 (see FIGS. 3 and 4A-4B).

The spool 140 varies in diameter along its length to form lands of variable diameters capable of selectively interconnecting the various passages intercepting the longitudinal bore 138 to control flow of fluid to and from the actuator. When the spool 140 is in a neutral (e.g., unactuated, centered, or unbiased) position as shown in FIG. 1C, the open-center passage is cleared. As such, fluid received at the inlet port 114 flows through inlet passage 146, the dual-wing passage 142, around land 156 of the spool 140 through the center passage 144. Fluid then flows to the dual-wing passage 142 of the section 106, and so on until fluid exits the center passage 144 of the valve section 102 into a chamber or passage 158 in the end section 112.

The fluid entering the end section 112, and specifically the passage 158, may then flow through any of multiple paths. For example, the fluid may flow through the bight 134 and then through a passage 159 intercepting the longitudinal bore of the valve section 102. The fluid is then communicated to passages(s) 159 of the valve sections 104, 106, and 108. The fluid going through the passage(s) 159 is a low pressure fluid, and thus the seals of the spool(s) 140 of the valve sections 102-108 are not subjected to high pressure levels.

The fluid entering the end section 112 through the open-center passage may also flow through the bight 124 and through the outlet port 120 to the reservoir. Rather than flowing through the outlet port 120 to the reservoir, the fluid may also traverse the above mentioned race-track fluid path down the leg portion 130 or the leg portion 132. The fluid may then flow through the respective first return passages 148 or the respective second return passages 150, through the leg portion 126 or the leg portion 128, and through the outlet port 116 to the reservoir.

Alternatively, some of the fluid may circulate through the race-track path back to the end section 112 and through the outlet port 120 to the reservoir. This race-track configuration provides multiple paths for the fluid to flow therethrough and may thus reduce the pressure drop across the valve assembly 100 when the spool(s) 140 are in the neutral position. Further, the race-track configuration may reduce backpressure for applications that involve large return flow rates (e.g., flow rates generated when using telescopic hydraulic cylinders).

Further, the end section 112 may have a "power beyond" port 160 that might be connected to other functions of a machine or vehicle to provide flow thereto.

Figure 1D:
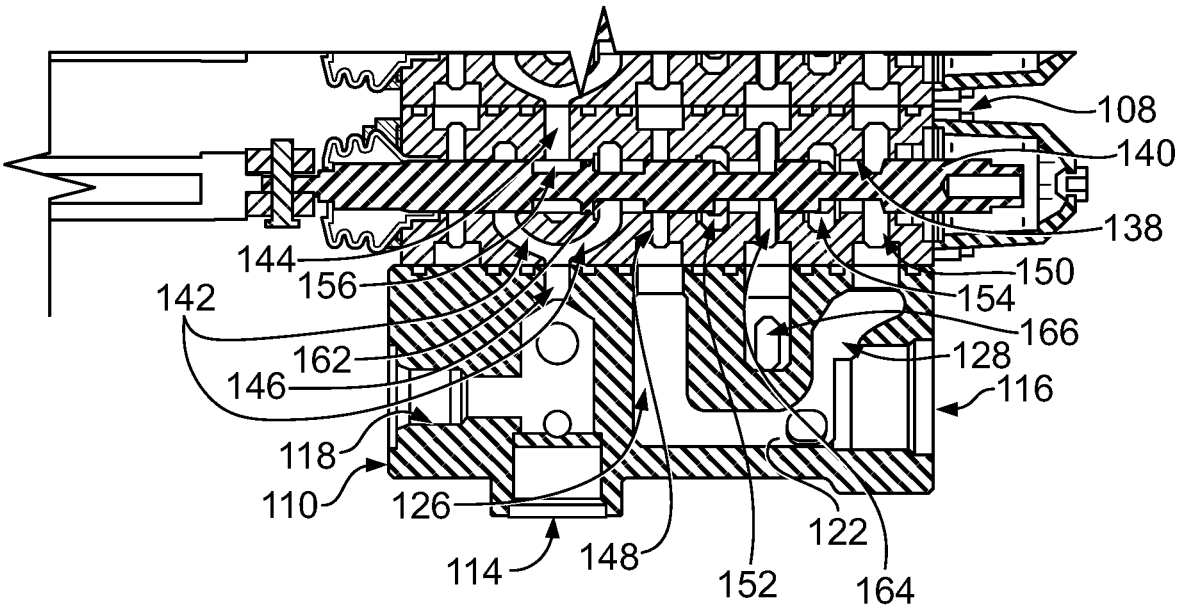
FIG. 1D illustrates a partial cross section of a valve section with a spool shifted in a first direction from a neutral position shown in FIG. 1C, in accordance with an example implementation.
Figure 1E:
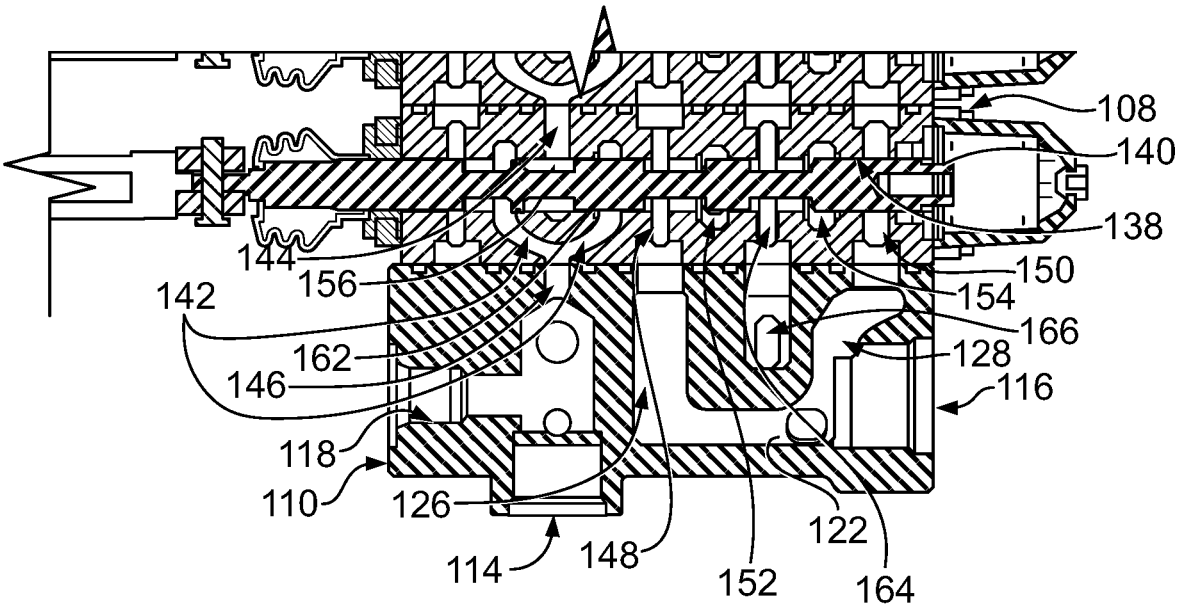
FIG. 1E illustrates a partial cross section of a valve section with a spool shifted in a second direction opposite the first direction from the neutral position shown in FIG. 1C, in accordance with an example implementation.

Upon shifting the spool 140 to actuate its associated actuator (e.g., hydraulic cylinder or motor), the shifted spool restricts or blocks fluid flow through the open-center passage (the dual-wing passage 142 and the center passage 144). FIG. 1D illustrates a partial cross section of the valve section 108 with the spool 140 shifted in a first direction from the neutral position shown in FIG. 1C, and FIG. 1E illustrates a partial cross section of the valve section 108 with the spool 140 shifted in a second direction opposite the first direction from the neutral position shown in FIG. 1C, in accordance with an example implementation. If the spool 140 is shifted to the right as shown in FIG. 1D, lands 156 and 161 restrict or block flow through the open-center passage. If the spool 140 is shifted to the left as shown in FIG. 1E, lands 156 and 162 restrict or block flow through the open-center passage. As fluid is restricted or blocked from flowing through the open-center passage, the fluid is diverted to a transversely extending supply passage 164 disposed in the housing 137 and intercepting the longitudinal bore 138 as described next.

Figure 2A:
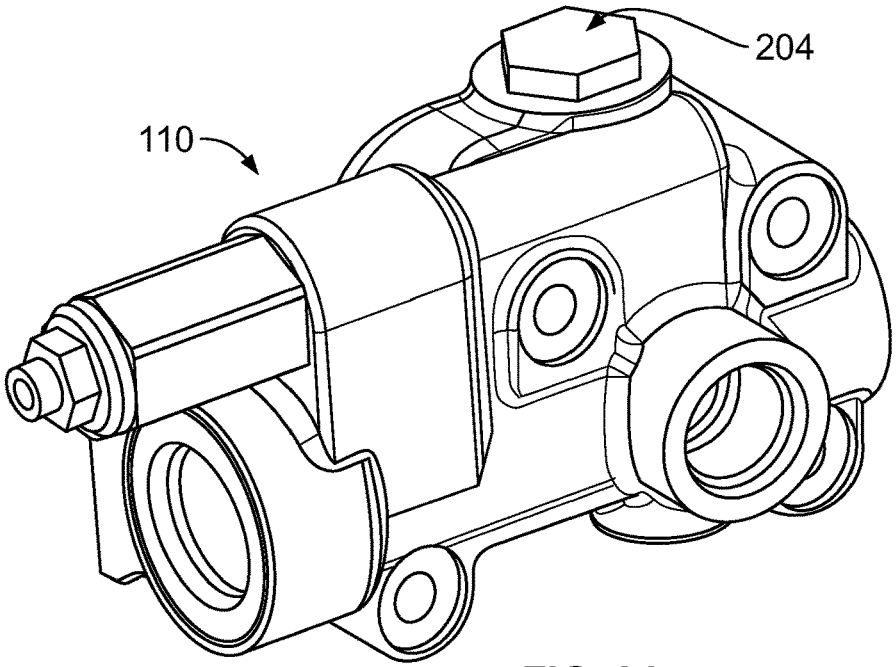
FIG. 2A illustrates a perspective view of an end section, in accordance with an example implementation.
Figure 2B:
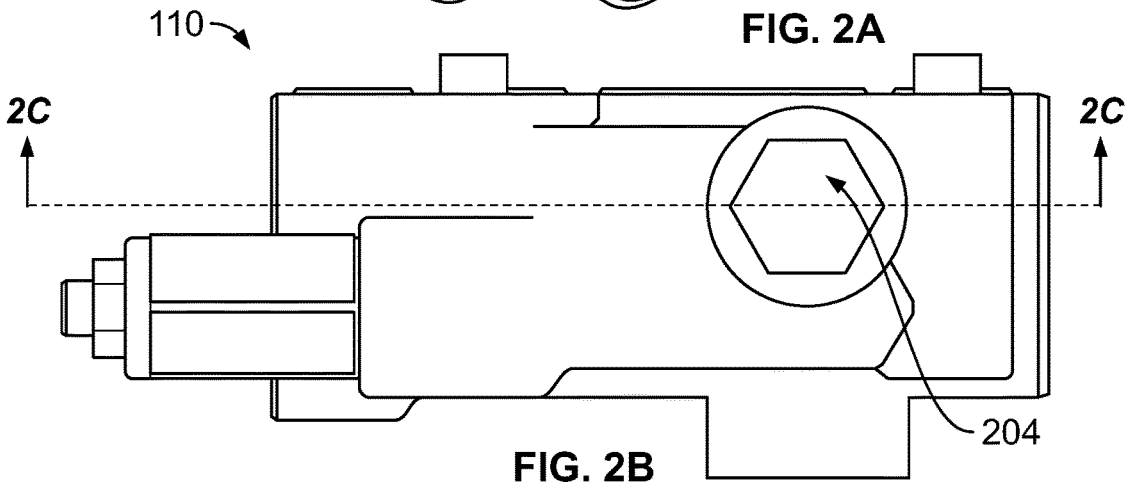
FIG. 2B illustrates a top view of the end section shown in FIG. 2A, in accordance with an example implementation.
Figure 2C:
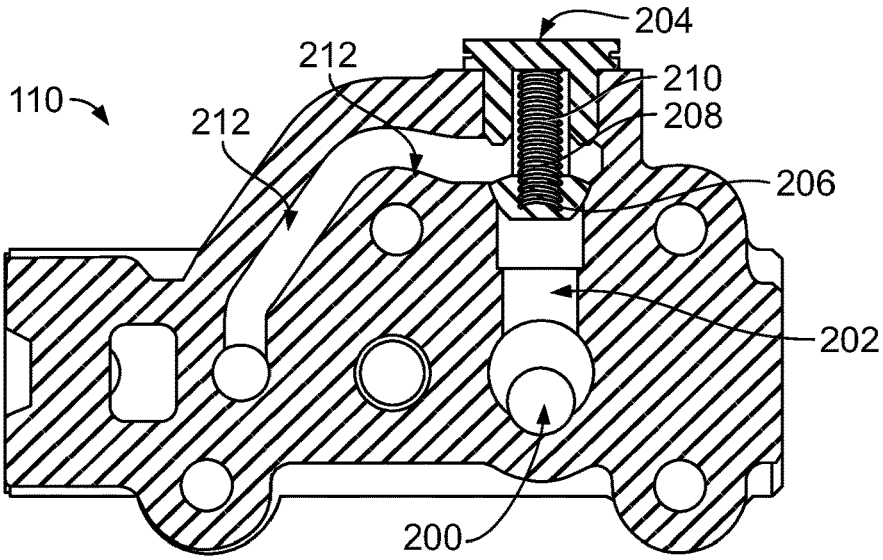
FIG. 2C illustrates a cross sectional side view of the end section shown in FIG. 2A, in accordance with an example implementation.

FIG. 2A illustrates a perspective view of the end section 110, FIG. 2B illustrates a top view of the end section 110, and FIG. 2C illustrates cross section A-A depicted in FIG. 2B of the end section 110, in accordance with an example implementation. As shown in FIG. 2C, the end section 110 has an opening 200 that receives fluid from the inlet port 114. When the spool 140 is shifted and the open-center passage is restricted or blocked, the fluid takes the path of least resistance and is diverted to flow through passage 202 in the end section 110.

Fluid in the passage 202 is initially blocked by a spring-loaded check valve 204. Particularly, the spring-loaded check valve 204 has a poppet 206 that initially blocks the fluid flowing through the passage 202. The poppet 206 defines therein an internal longitudinal channel 208 that operates as a guide for a spring 210. The spring 210 pre-loads and supports the poppet 206 to block the fluid flowing through the passage 202. Because the fluid is blocked at both the open-center passage by the spool 140 and at the passage 202 by the spring-loaded check valve 204, fluid pressure level increases.

Pressure level of the fluid builds up until the pressure level exceeds a predetermined threshold pressure level determined by the spring rate of the spring 210. When the pressure level of the fluid in the passage 202 exceeds the predetermined threshold pressure level, the fluid pushes the poppet 206 against the spring 210 and flows through a passage 212. The passage 202 and the passage 212 form a fluid diversion passage used to divert fluid from the open-center passage to the supply passage 164.

Referring back to FIGS. 1C, 1D, and 1E, fluid flowing through the passage 212 is then communicated to a passage 166 in the end section 110, and then to the supply passage 164 of the valve section 108. The supply passage 164 is annular and fluid thus flows about the spool 140 and continues to flow through respective supply passages 164 of the valve sections 106, 104, and 102, and is then blocked by the end section 112 at interface 168. Blocking the flow at the interface 168 allows pressure level of the fluid to increase.

Further, when the spool 140 is shifted, fluid flowing through the supply passage 164 flows to either the workport passage 152 or the workport passage 154 based on direction of travel of the spool 140. For instance, as shown in FIG. 1D, if the spool 140 moves to the right relative to the neutral position in FIG. 1C, fluid in the supply passage 164 flows to the workport passage 152. The workport passage 152 is connected via a duct to a workport configured to be coupled to a first side or chamber of the actuator controlled by the valve section 108 (see FIG. 4A). Fluid discharged from an opposite second side or chamber of the actuator flows through a respective duct to the workport passage 154. The shifted position of the spool 140 to the right allows fluid received at the workport passage 154 to flow to the adjacent or corresponding return passage 150. The fluid then enters the race-track fluid path and is ultimately exhausted through the outlet port 116 or 120 to the reservoir.

On the other hand, as shown in FIG. 1E, if the spool 140 moves to the left relative to the neutral position in FIG. 1C, fluid in the supply passage 164 flows to the workport passage 154. The workport passage 154 is connected via a duct to a workport configured to be coupled to the second side or chamber of the actuator controlled by the valve section 108 (see FIG. 4A). Fluid discharged from the first side or chamber of the actuator flows through a respective duct to the workport passage 152. The shifted position of the spool 140 to the left allows fluid received at the workport passage 152 to flow to the adjacent or corresponding return passage 148. The fluid then enters the race-track fluid path and is ultimately exhausted through the outlet port 116 or 120 to the reservoir.

As shown and described with respect to FIGS. 1C, 1D, and 1E the open-center passage is disposed on one side of the valve sections 102-108 (e.g., the left side in FIG. 1), whereas the supply passage(s) 164, the workport passages 152 and 154, and the return passages 148 and 150 are disposed on the other side of the valve sections 102-108. In other words, the supply passage(s) 164, the workport passages 152 and 154, and the return passages 148 and 150 are disposed on the same side relative to the open-center passages. This contrast with open-center valve designs that involve having the open-center passage in the middle of the valve section while having a workport passage, a supply passage, and return passage on one side of the open-center passage, while having another workport passage, another supply passage, and another return passage on the other side of the open-center passage. The construction shown in the valve assembly 100 of FIGS. 1A-1E enables having two workports disposed on the same side of the valve section as described below with respect to FIGS. 3 and 4A-4B.

Further, a single supply passage 164 is disposed between, and configured to feed, both workport passages 152 and 154, rather than having two distinct supply passages, one for each workport passage on either side of the open-center passage. Having a single, large supply passage rather than two smaller more restricted supply passages may reduce pressure drop across the supply passage, and render the valve assembly 100 more efficient.

Figure 3:
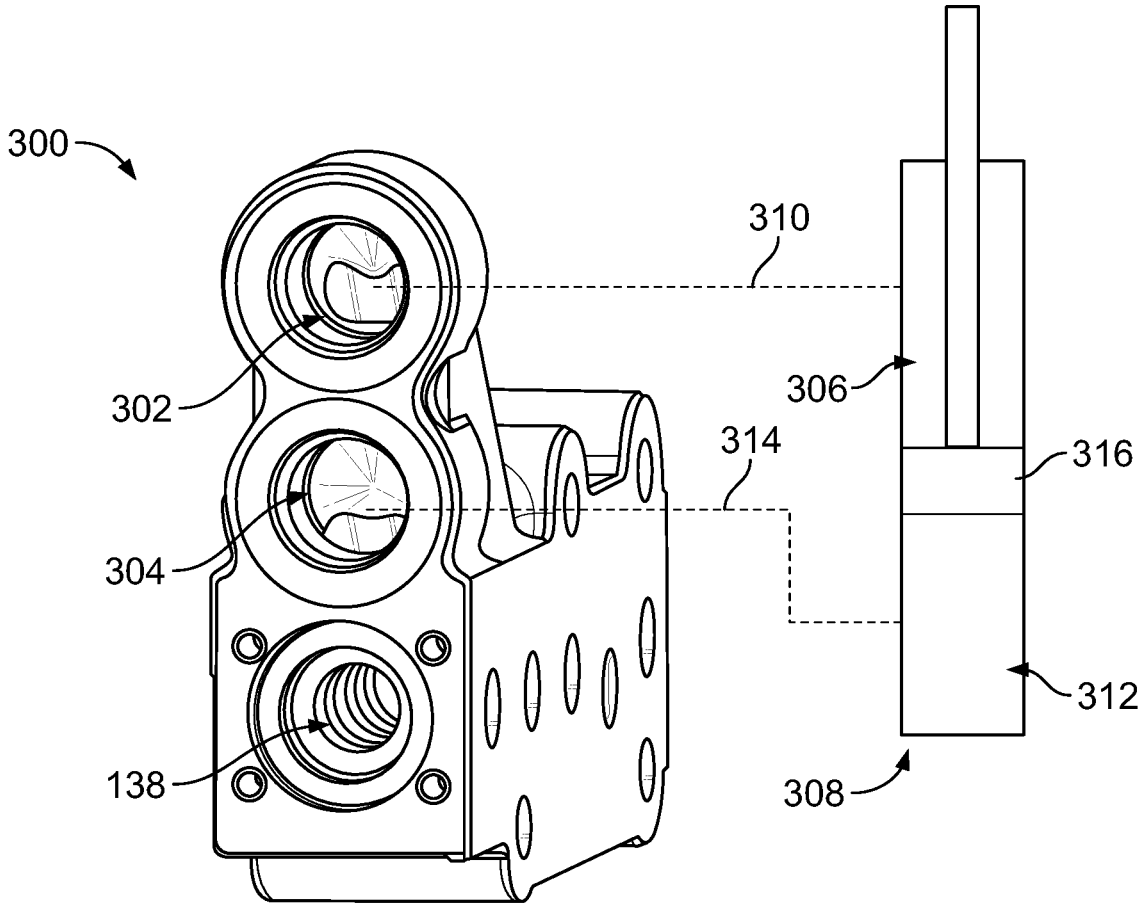
FIG. 3 illustrates a perspective view of a valve section, in accordance with another example implementation.

FIG. 3 illustrates a perspective view of a valve section 300, in accordance with an example implementation. The valve section 300 could represent any of the valve sections 102, 104, 106, or 108 of the valve assembly 100. The valve section 300 defines therein the longitudinal bore 138 configured to receive the spool 140 as described above. Further, the valve section 300 has a first workport 302 and a second workport 304 orientated on one end of a given side of the valve section 300 in a plane perpendicular to a plan of the cross section shown in FIG. 1. The workports 302 and 304 are also oriented in the same direction.

This configuration of having the workports 302 and 304 on the same side of the valve section facing in the same direction is enabled by the construction described in FIG. 1C with the workport passages 152 and 154 disposed on the same side of the valve section relative to the open-center passage. The configuration shown in FIG. 3 allows external plumbing (e.g., hoses or hydraulic lines to the workports 302-304) to be routed in a compact arrangement rendering a lower profile for the hydraulic system involving the valve assembly 100.

As an example for illustration, the workport 302 may be coupled to a chamber 306 of a hydraulic cylinder 308 via a hydraulic line 310, and the workport 304 may be coupled to a chamber 312 of the hydraulic cylinder 308 via a hydraulic line 314. The workport 302 may further be fluidly coupled via a duct within the valve section 300 to the workport passage 152, and the workport 304 may be fluidly coupled via a respective duct within the valve section 300 to the workport passage 154.

Thus, when the spool 140 is shifted to the right as shown in FIG. 1D, pressurized fluid is communicated to the workport passage 152 and through the duct within the valve section 300 to the workport 302. Fluid then flows through the hydraulic line 310 to the chamber 306 causing a piston 316 of the hydraulic cylinder 308 to retract. Fluid discharged from the chamber 312 flows through the hydraulic line 314 through the workport 304 and the respective duct within the valve section 300 to the workport passage 154. From the workport passage 154, fluid is communicated via a path formed by the shifted spool 140 to the return duct 150 and ultimately to the reservoir.

If the spool 140 is shifted to the left as shown in FIG. 1E, pressurized fluid is communicated to the workport passage 154, through the respective duct within the valve section 300 to the workport 304. Fluid then flows through the hydraulic line 314 to the chamber 312 causing the piston 316 of the hydraulic cylinder 308 to extend. Fluid discharged from the chamber 306 flows through the hydraulic line 310 through the workport 302 and the duct within the valve section 300 to the workport passage 152. From the workport passage 152, fluid is communicated via a path formed by the shifted spool 140 to the return duct 148 and ultimately to the reservoir.

In examples, a hydraulic system may have two actuators (e.g., two hydraulic cylinders) that are actuated in the same direction in tandem. In these examples, flow of the pressurized fluid exiting a valve section is split to be delivered to both actuators. Such split could be implemented externally via additional blocks or manifolds that add to the complexity and cost of the system. Thus, to reduce cost and complexity, the valve section described next incorporates four workports to enable an internal flow split, rather than an externally-implemented flow split.

Figure 4A:
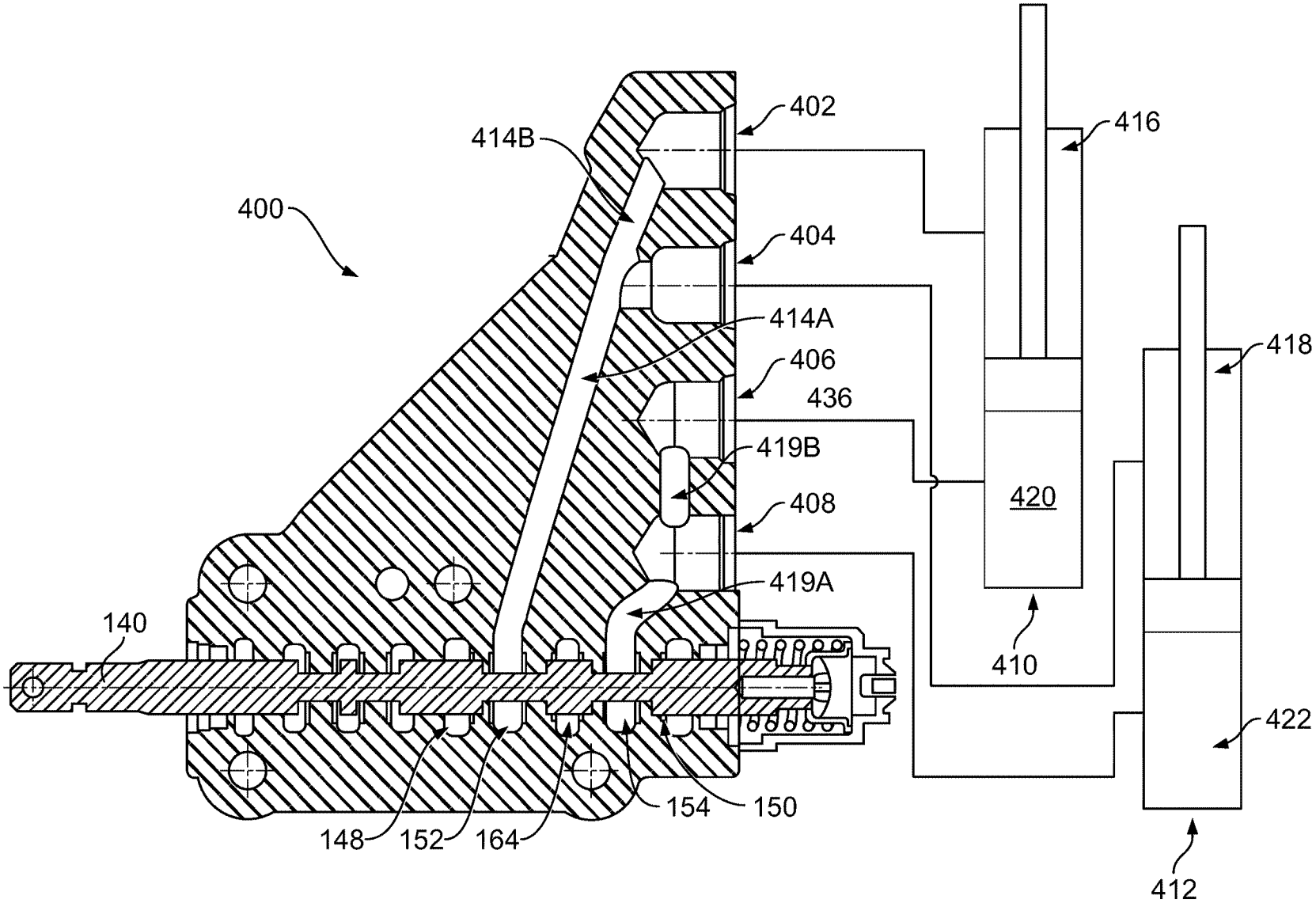
FIG. 4A illustrates a valve section incorporating four workports to implement internal flow split, in accordance with an example implementation.

FIG. 4A illustrates a valve section 400 incorporating four workports to implement internal flow split, in accordance with an example implementation. The valve section 400 includes a first workport 402, a second workport 404, a third workport 406, and a fourth workport 408. The four workports 402-408 are orientated on one end of a given side of the valve section 400 in a plane perpendicular to a plan of the cross section shown in FIGS. 1C, 1D, and 1E, and the four workports 402-408 are oriented in the same direction.

This configuration of having the workports 402-408 on the same side of the valve section is enabled by the construction described in FIG. 1C with the workport passages 152 and 154 on the same side of the valve section relative to the open-center passage. The configuration shown in FIG. 4A allows the external plumbing (e.g., hoses or hydraulic lines to the workports 402-408) to be routed in a compact arrangement rendering a lower profile for the hydraulic system involving the valve assembly 100.

Further, the configuration shown in FIG. 4A allows for internal splitting of flow to drive two hydraulic actuators 410 and 412 in tandem. As shown in FIG. 4A, the workport passage 152 is fluidly coupled via ducts 414A and 414B to the workports 402 and 404. Therefore, when the hydraulic actuators 410 and 412 retract, fluid flowing from the workport passage 152 is split between the workports 402 and 404. Fluid exiting the workports 402 and 404 is then communicated via respective hydraulic lines to chambers 416 and 418 respectively. On the other hand, when the hydraulic actuators 410 and 412 extend, fluid discharged from the chambers 416 and 418 is communicated via hydraulic lines to the workports 402 and 404 respectively. Fluid is then combined in the duct 414A and delivered to the workport passage 152.

Further, the workport passage 154 is fluidly coupled via ducts 419A and 419B to the workports 406 and 408. Thus, when the hydraulic actuators 410 and 412 extend, fluid flowing from the workport passage 154 is split between the workports 406 and 408. Fluid exiting the workports 406 and 408 is then communicated via respective hydraulic lines to chambers 420 and 422 of the hydraulic actuators 410 and 412, respectively. When the hydraulic actuators 410 and 412 retract, fluid discharged from the chambers 420 and 422 is communicated via hydraulic lines to the workports 406 and 408 respectively. Fluid is then combined in the duct 419A and delivered to the workport passage 154.

With this configuration, flow split is implemented internally in the valve section rather than by adding external blocks or manifolds.

Figure 4B:
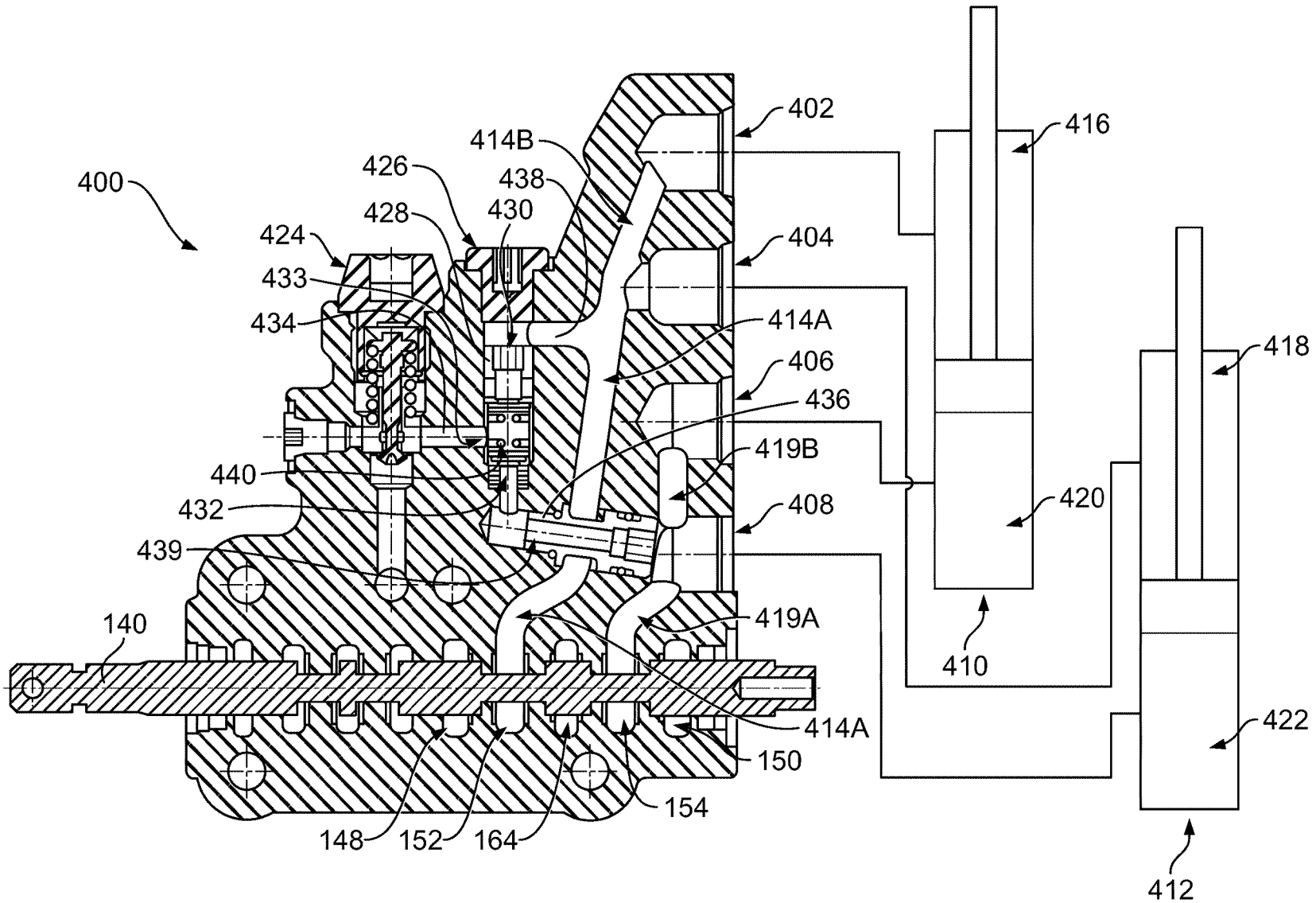
FIG. 4B illustrates a valve section using a single relief valve for the valve section shown in FIG. 4A, in accordance with an example implementation.

FIG. 4B illustrates using a single relieve valve 424 for the valve section 400, in accordance with an example implementation. The relief valve 424 is used to protect both chambers of an actuator, rather than using a relief valve for each chamber or workport. As shown in FIG. 4B, the valve section 400 includes a shuttle valve 426. The shuttle valve 426 includes a shuttle valve body 428 defining a first shuttle inlet 430 and a second shuttle inlet 432. The second shuttle inlet 432 is coaxial with, and mounted opposite to, the first shuttle inlet 430. The shuttle valve 426 also includes a shuttle outlet 433 disposed transverse to the first and second inlets 430 and 432. The shuttle outlet 433 is connected to the relief valve 424 via channel 434.

The valve section 400 includes a tube member or sleeve 436 that separates flow through the ducts 414A-414B from flow through the ducts 419A-419B. Particularly, flow is communicated between the ducts 414A and 414B about a circumferential groove disposed on an exterior peripheral surface of the sleeve 436. Further, flow associated with the workports 402-404 and the ducts 414A-414B is communicated to the first shuttle inlet 430 of the shuttle valve 426 through channel 438. The sleeve 436 also defines therein a longitudinal channel 439, which communicates fluid in the ducts 419A-419B to the second shuttle inlet 432. Thus, flow associated with the workports 406 and 408 is communicated to the second shuttle inlet 432 via the longitudinal channel 439.

The shuttle valve 426 further includes a movable member 440 (e.g., spool, ball, poppet, etc.) movable within the shuttle valve body 428. The movable member 440 is configured to shift between a first position adjacent to the first shuttle inlet 430 and a second position adjacent to the second shuttle inlet 432. In the first position, the movable member 440 blocks the first shuttle inlet 430 while connecting the channel 439 to the shuttle outlet 433 through the second shuttle inlet 432. Thus, in the first position, flow associated with the workport passage 154, the ducts 419A-419B, and the workports 406-408 is communicated to the relief valve 424.

In the second position, the movable member 440 blocks the second shuttle inlet 432 while connecting the channel 438 to the shuttle outlet 433 through the first shuttle inlet 430. Thus, in the second position, flow associated with the workport passage 152, the ducts 414A-414B, and the workports 402-404 is communicated to the relief valve 424.

With is configuration, the relief valve 424 operates to relieve any pair of workports 402-404 or 406-408 that has the higher pressure level. This contrasts with using a separate relief valve for each pair of workports. The configuration of FIG. 4B could also be implemented in the valve section 300 described above to relieve any of the workports 302 or 304 that has the higher pressure level instead of using two relief valves, one for the workport 302 and another for the workport 304.

It should be understood that any combination of features shown and discussed with respect to FIGS. 1A-4B could be implemented in the same valve assembly. For instance, any combination of sections having two-port, four-port, four-port with a single relief valve etc. can be combined in the same stack of valve sections or in the same valve assembly. For example, one valve section could have two ports, the adjacent valve section could have four ports, a third valve section could have a relief valve, and so forth.

Figure 5:
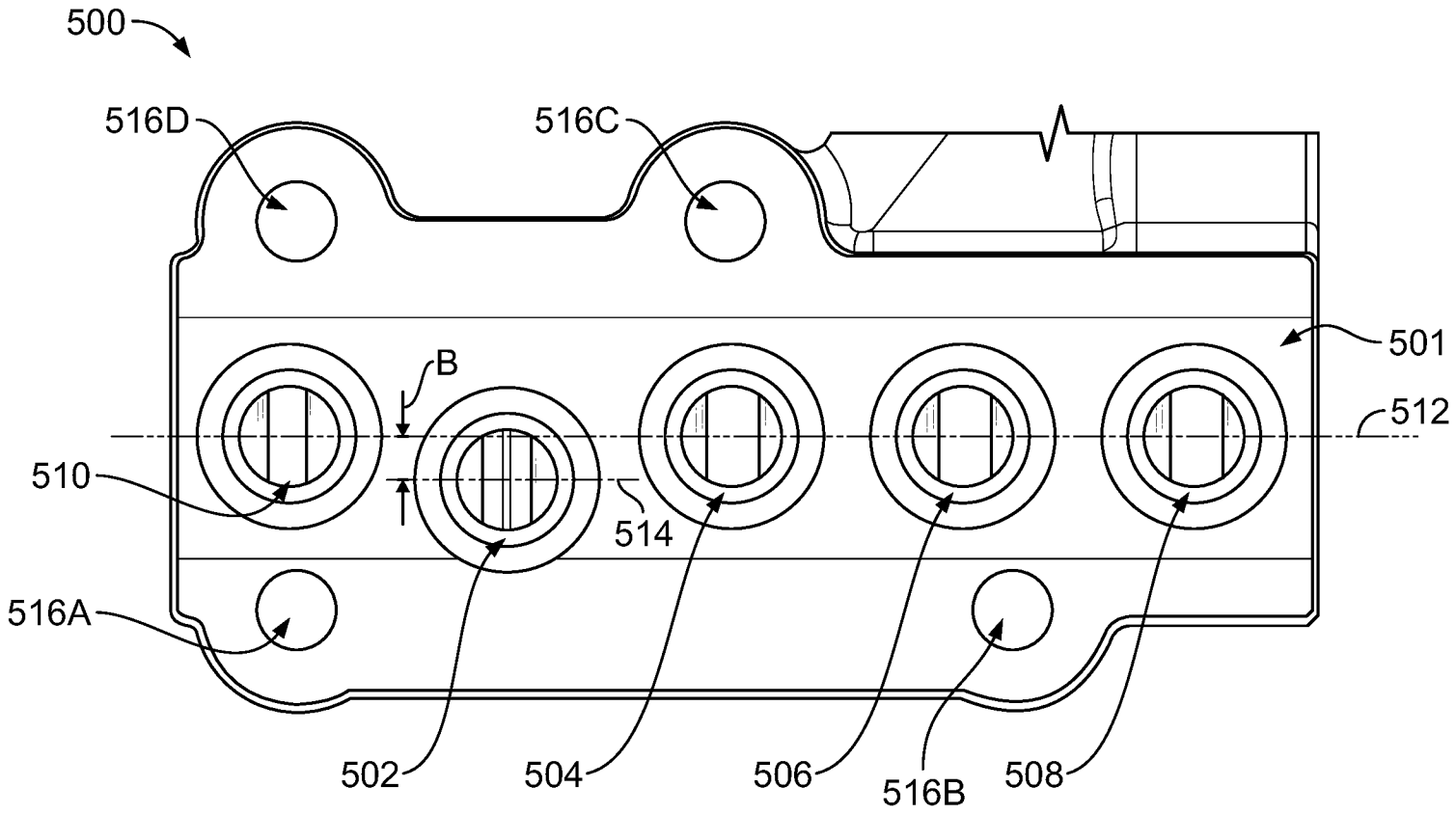
FIG. 5 illustrates a side view of a valve cross section, in accordance with an example implementation.

FIG. 5 illustrates a side view of a valve cross section 500, in accordance with an example implementation. The valve section 500 may represent any of the valve sections 102-108, 300, or 400. The valve section 500 has a substantially planar surface 501 that includes an opening 502 to the open-center passage (e.g., the dual-wing passage 142). The planar surface 501 also has an opening 504 to the return passage 148, an opening 506 to the supply passage 164, and an opening 508 to the return passage 150. The planar surface 501 further has an opening 510 to the passage 159.

As illustrated in FIG. 5, while the openings 504, 506, 508, and 510 are longitudinally aligned (e.g., respective centers of each of the openings 504, 506, 508, and 510 are aligned) relative to each other, whereas the opening 502 is transversely offset on the planar surface 501 relative to the openings 504, 506, 508, and 510. For instance, a longitudinal line 512 passes through respective centers of the openings 504, 506, 508, and 510, and a longitudinal line 514 passes through a center of the opening 502. The longitudinal line 514 is parallel to, but is offset by a distance "e" from, the longitudinal line 512.

With this configuration, the entrance, e.g., the opening 502, to the open-center passage is lowered to enhance management of stresses resulting from pressurized fluid acting on the walls or surfaces that define the longitudinal bore 138. This configuration may reduce impact of high pressure fluid on these surfaces so as to reduce distortion of the longitudinal bore 138. With a reduced distortion of the longitudinal bore 138, better valve performance may be achieved as the probability of the spool 140 binding within the longitudinal bore 138 is reduced. As a result, the amount of diametrical clearance between the spool 140 and the longitudinal bore 138 may be reduced, thus enhancing valve performance (e.g., reducing leakage, improving efficiency, etc.).

Each valve section or end section may have holes therein such as holes 516A, 516B, 516C, and 516D shown in FIG. 5. Tie-rods or tie-bolts are inserted through the respective aligned holes of the sections to secure the sections to each other.

Figure 6A:
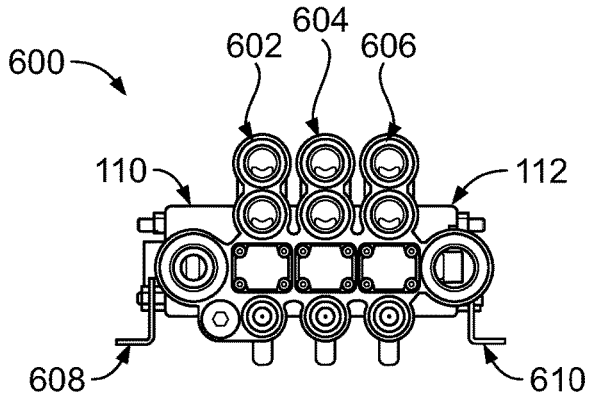
FIG. 6A illustrates a side view of a valve assembly including three valve sections positioned between two end sections, in accordance with an example implementation.

FIG. 6A illustrates a side view of a valve assembly 600 including three valve sections 602, 604, and 606 positioned between the end sections 110 and 112, in accordance with an example implementation. The valve assembly 600 may be similar to the valve assembly 100, but has three valve sections 602, 604, and 606 positioned adjacent to one another between the end sections 110 and 112, instead of four valve sections 102-108 as shown in FIG. 1.

The valve sections 602-606 and the end sections 110-112 are mounted adjacent to each other and tie-bolts are used to secure them to each other as mentioned above. Further, the end section 110 may be coupled to a first mounting bracket or plate 608 and the end section 112 may be coupled to a second mounting bracket or plate 610. The mounting plates 608 and 610 are coupled to the valve assembly 600 via the tie-bolts and are used to couple or affix the valve assembly 600 to a machine or vehicle.

Figure 6B:
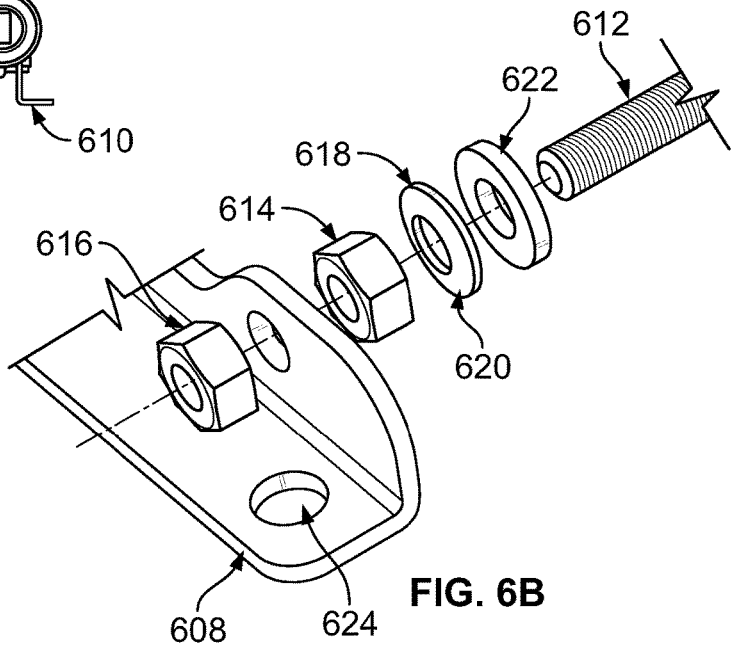
FIG. 6B illustrates coupling a tie-bolt to a mounting plate, in accordance with an example implementation.

FIG. 6B illustrates coupling a tie-bolt 612 to the mounting plate 608, in accordance with an example implementation. The tie-bolt 612 is inserted through respective holes of the valve sections 602-606 and is attached to the mounting plate 608 with jam nuts 614 and 616.

The valve sections 602-606 and the end sections 110 and 112 are thus clamped to each other via tie-bolts such as the tie-bolt 612. The tie-bolts are pre-loaded so as to preclude leakage of hydraulic fluid between the sections abutted to each other.

In examples, the valve assembly or 600 may operate throughout a wide range of temperatures (e.g., between −40° F. and 180° F.). Further, the valve sections 602-606 and the end sections 110 and 112 may be made of a material that is different from the material of the tie-bolts. For instance, the valve sections 602-606 and the end sections 110 and 112 may be made of aluminum, whereas the tie-bolts, e.g., the tie-bolt 612, may be made of steel. Therefore, the valve sections 602-606 and the end sections 110 and 112 may have different thermal coefficient of expansion and contraction compared to the tie-bolts.

Thus, as the operating temperature varies, the valve sections 602-606 and the end sections 110 and 112 may expand or contract at a different rate compared to the tie-bolts. Such discrepancy in the expansion or contraction rate may cause plastic deformation of the tie-bolts or distortion of the valve sections 602-606 and end section 110-112, resulting in spool bind at high temperatures. Further, if plastic deformation of the tie-bolts occurs at high operating temperatures, loss of pre-load may result. Subsequent operation at low temperatures may cause an increased likelihood of inter-section seal failure and fluid leakage.

In some examples, to accommodate the discrepancy in the expansion or contraction rate of the valve sections 602-606 and end section 110-112 compared to the tie-bolts throughout the range of operating temperatures, the tie-bolt 612 may interface with the mounting plate 608 via a Bellville spring washer 618 that facilitates maintaining the pre-load of the tie-bolts. The Belleville spring washer 618 is oriented such that a crown 620 of the Belleville spring washer 618 faces toward the jam nut 614, which is used to couple the tie-bolt 612 to the mounting plate 608.

The Belleville spring washer 618 is used herein as an example for illustration. In other examples, any type of a compliant or elastic washer (e.g., a washer made of an elastic material) could be used to accommodate displacements of components of the valve assembly 600 relative to each other.

A flat washer 622 may also be disposed adjacent to the Belleville spring washer 618 so as to distribute the pressure of the Belleville spring washer 618 evenly over its surface facing the washer 622. The washer 622 may also ensure that the Belleville spring washer 618 is pressed against a smooth surface of the washer 622. This configuration may reduce the likelihood that the Belleville spring washer 618 could loosen. The configuration shown in FIG. 6B could be used with all tie-bolts holding the valve assembly 600 together at the interface between each tie-bolt and a respective mounting plate of the mounting plates 608 and 610.

The mounting plate 608 may include holes such as hole 624 that facilitate attaching the mounting plate 608, and thus attaching the valve assembly 600, to the vehicle or machine. Bolts or any type of fasteners could be used to affix the mounting plate 608 to the machine. The other mounting plate 610 may have similar holes as well.

Figure 6C:
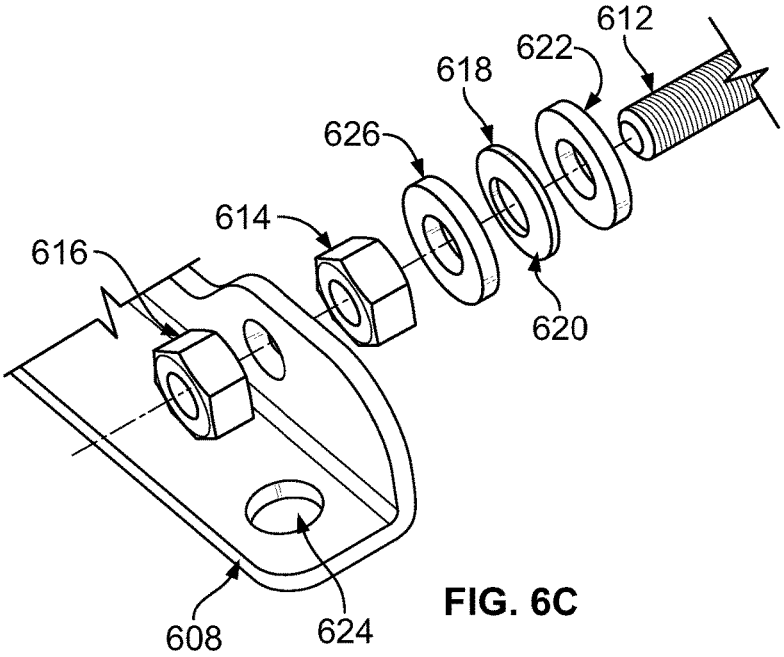
FIG. 6C illustrates using two flat washers to couple a tie-bolt to a mounting plate, in accordance with an example implementation.

FIG. 6C illustrates using two flat washers surrounding the Belleville spring washer 618 to couple the tie-bolt 612 to the mounting plate 608, in accordance with an example implementation. As mentioned above with respect to FIG. 6B, the Belleville spring washer 618 is oriented such that the crown 620 of the Belleville spring washer 618 faces toward the jam nut 614. In other examples, as shown in FIG. 6C, a second flat washer 626 in addition to the flat washer 622 could be used, such that the Belleville spring washer 618 could have any orientation. As shown in FIG. 6C, the Belleville spring washer 618 is sandwiched or disposed between the flat washer 622 and the flat washer 626. With this configuration, the Belleville spring washer 618 could be oriented such that the crown 620 faces the flat washer 622 or the flat washer 626.

Although FIGS. 1A and 1C illustrate four valve sections 102-108 and FIG. 6A illustrates three valve sections 602-608 positioned adjacent to one another between the end sections 110 and 112, in other examples, a valve assembly may include up to 24 valve sections or more adjacent to one another between the end sections 110 and 112. Each valve section may be configured to control an actuator of a vehicle or a machine.

As an example for illustration, if 24 valve sections are used, an overall length of the valve assembly may be over 41.5 inches. If the valve sections are misaligned when stacking such a high number of valve sections together, valve sag may occur, thereby causing problems with spool bore distortion and spool bind. Misalignment of the stacked valve sections may also cause fretting corrosion and other issues inside the tie-bolt holes arising from the vibratory movement between tie-bolts and the valve sections.

Figure 7:
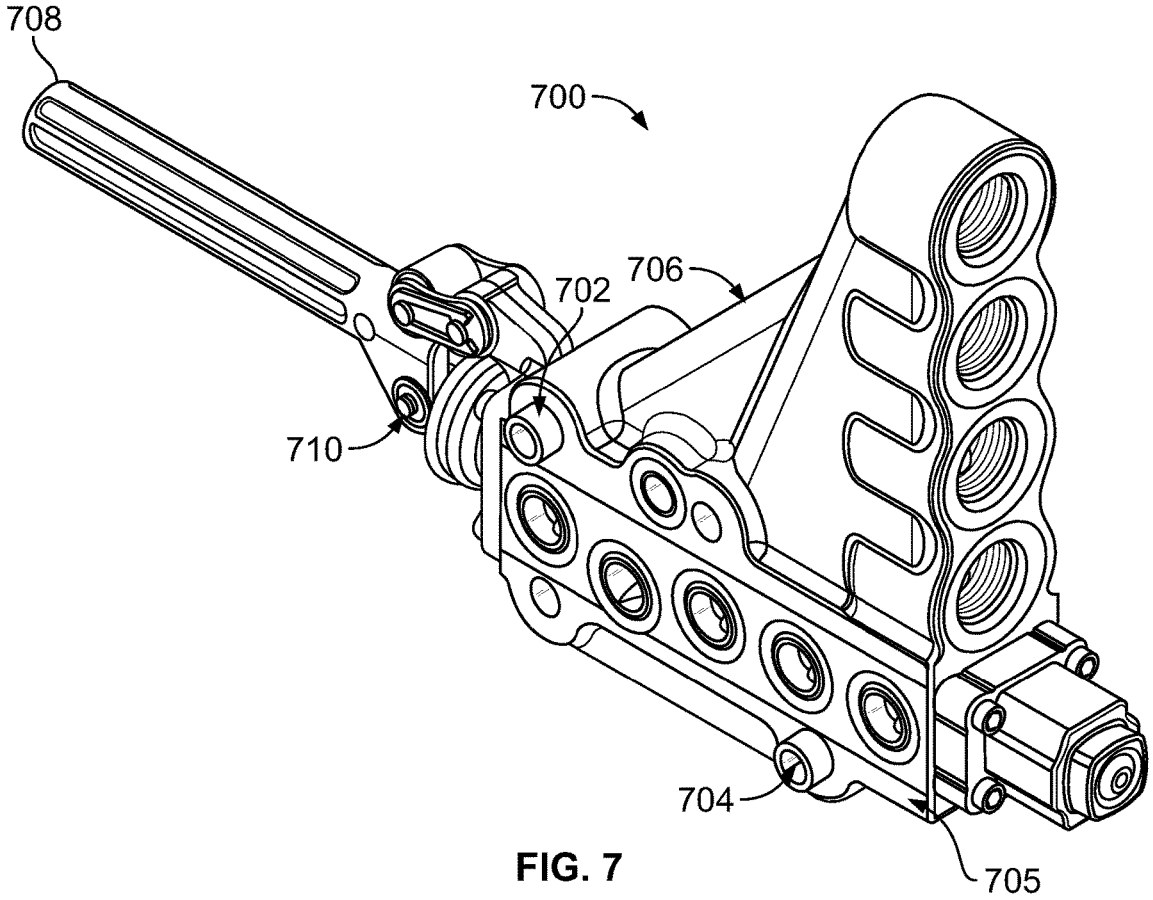
FIG. 7 illustrates a valve section having two guide pins, in accordance with an example implementation.

FIG. 7 illustrates a valve section 700 having guide pins 702 and 704, in accordance with an example implementation. To facilitate aligning a large number of sections, each valve section 700 may have guide bushings or guide pins 702 and 704 mounted to and protruding from a substantially planar surface 705 of a housing 706 of the valve section 700. An adjacent section may have two corresponding holes configured to receive the guide pins 702 and 704 thereat. With this configuration, a large number of valve sections could be stacked and mounted to each other while being properly aligned to prevent sagging and other issues associated with misalignment.

As shown in FIG. 7, a handle 708 could be mounted to each valve section such as valve section 700. The handle 708 could be coupled to a spool (e.g., the spool 140) of the valve section 700. The handle 708 facilitates manually actuating the valve section 700. Particularly, rotating the handle 708 about a pivot 710 causes the spool within the housing 706 to move axially within its longitudinal bore (e.g., the longitudinal bore 138). In other examples, however, the spools could be electrically actuated. With this configuration, the spool is manually-movable by the handle 708 coupled to the spool.

Figure 8:
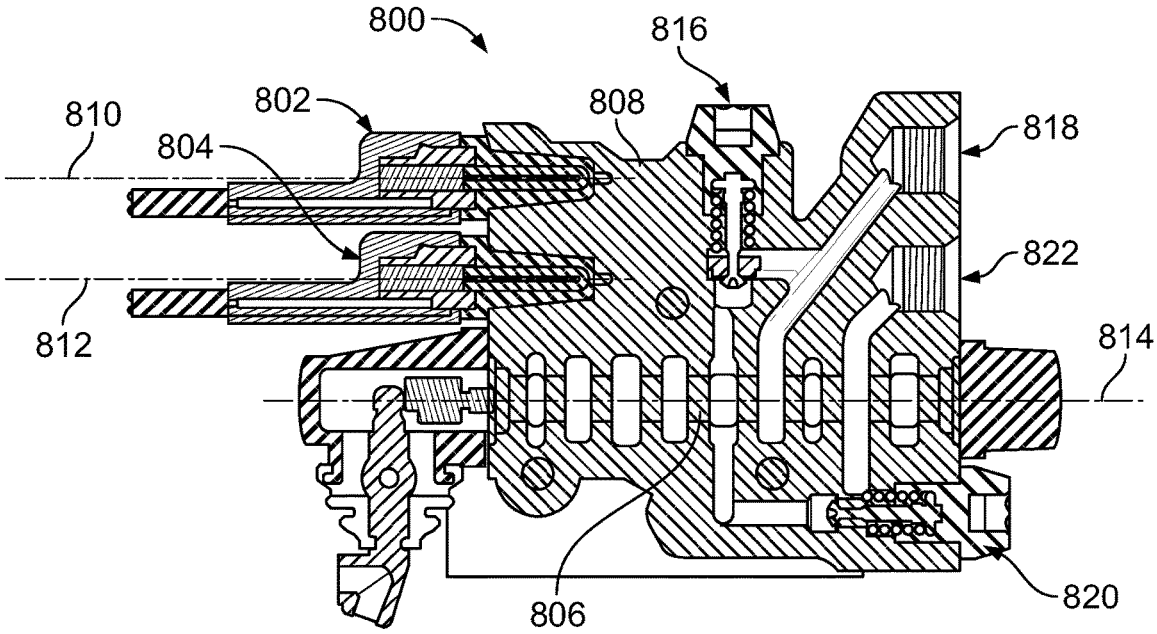
FIG. 8 illustrates a valve section having electrically actuated pilot valves, in accordance with an example implementation.

FIG. 8 illustrates a valve section 800 having electrically-actuated pilot valves 802 and 804, in accordance with an example implementation. As an example, each pilot valve 802, 804 may be actuatable by a solenoid, such that when an electric signal is provided to a respective solenoid, the respective pilot valve is actuated and provides pressurized fluid to one end of a spool 806.

For instance, if the pilot valve 802 is electrically actuated, pressurized fluid is provided through cross drill holes (not shown) in a housing 808 of the valve section 800 to a first end of the spool 806, thereby causing the spool 806 to shift in a first direction. On the other hand, if the pilot valve 804 is electrically actuated, pressurized fluid is provided through cross drill holes (not shown) in the housing 808 to a second end of the spool 806 opposite its first end, thereby causing the spool 806 to shift in a second direction longitudinally-opposite to the first direction.

As shown in FIG. 8, the pilot valves 802 and 804 are disposed the housing 808 of the valve section 800 parallel to each other on a given side of the valve section 800. Further, the pilot valves 802 and 804 are oriented such that longitudinal axes 810 and 812 of the pilot valves 802 and 804, respectively, are parallel to a longitudinal axis 814 of the spool 806. However, other orientations are possible.

FIG. 8 also illustrates a variation in the configuration of workport relief valves. As described with respect to FIG. 4B, a single workport relief valve could be used to protect both chambers of an actuator rather than using a relief valve for each chamber. However, in some examples, it may be desirable to have respective relief valve associated with each chamber so as to designate a different pressure setting for each chamber.

FIG. 8 illustrates the valve section 800 having a first relief valve 816 configured to protect a first chamber of an actuator fluidly coupled to workport 818. The valve section 800 may also have a second relief valve 820 configured to protect a second chamber of the actuator fluidly coupled to workport 822. Each of the relief valves 816 and 820 may have a respective setting different from the other relief valve.

The detailed description above describes various features and operations of the disclosed systems with reference to the accompanying figures. The illustrative implementations described herein are not meant to be limiting. Certain aspects of the disclosed systems can be arranged and combined in a wide variety of different configurations, all of which are contemplated herein.

Further, unless context suggests otherwise, the features illustrated in each of the figures may be used in combination with one another. Thus, the figures should be generally viewed as component aspects of one or more overall implementations, with the understanding that not all illustrated features are necessary for each implementation.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

Further, devices or systems may be used or configured to perform functions presented in the figures. In some instances, components of the devices and/or systems may be configured to perform the functions such that the components are actually configured and structured (with hardware and/or software) to enable such performance. In other examples, components of the devices and/or systems may be arranged to be adapted to, capable of, or suited for performing the functions, such as when operated in a specific manner.

By the term "substantially" it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide The arrangements described herein are for purposes of example only. As such, those skilled in the art will appreciate that other arrangements and other elements (e.g., machines, interfaces, operations, orders, and groupings of operations, etc.) can be used instead, and some elements may be omitted altogether according to the desired results. Further, many of the elements that are described are functional entities that may be implemented as discrete or distributed components or in conjunction with other components, in any suitable combination and location.

While various aspects and implementations have been disclosed herein, other aspects and implementations will be apparent to those skilled in the art. The various aspects and implementations disclosed herein are for purposes of illustration and are not intended to be limiting, with the true scope being indicated by the following claims, along with the full scope of equivalents to which such claims are entitled. Also, the terminology used herein is for the purpose of describing particular implementations only, and is not intended to be limiting.

What is claimed is:

1. A valve section comprising:

a housing having: (i) a longitudinal bore, (ii) a first and second workport passages intercepting the longitudinal bore, (iii) a first and second return passages intercepting the longitudinal bore, (iv) an open-center passage intercepting the longitudinal bore and configured to be fluidly coupled to a source of fluid, (v) a supply passage intercepting the longitudinal bore, (vi) a first port connected to the first workport passage, wherein the first port is configured to be fluidly coupled to a first chamber of a first actuator, (vii) a second port connected to the second workport passage, wherein the second port is configured to be fluidly coupled to a second chamber of the first actuator, and wherein the first port and the second port are disposed on a particular side of the housing and oriented in same direction, (viii) a third port connected to the first workport passage, wherein the third port is configured to be fluidly coupled to a respective first chamber of a second actuator, and (ix) a fourth port connected to the second workport passage, wherein the fourth port is configured to be fluidly coupled to a respective second chamber of the second actuator, and wherein the third and fourth ports are disposed on the particular side of the housing and oriented in the same direction as the first and second ports; and a spool movable in the longitudinal bore to shift between: (i) a neutral position that allows the open-center passage to permit fluid flow therethrough, and (ii) a shifted position that allows fluid to be diverted from the open-center passage to the supply passage, and connects the supply passage to either the first or second workport passage while connecting the other workport passage to a corresponding return passage of the first and second return passages.

2. The valve section of claim 1, further comprising:

a shuttle valve disposed in the housing and comprising: (i) a shuttle valve body defining a first inlet connected to the first workport passage, a second inlet connected to the second workport passage, and an outlet, wherein the second inlet is coaxial with, and mounted opposite to, the first inlet, and wherein the outlet is disposed transverse to the first and second inlets, and (ii) a movable member that is movable within the shuttle valve body to shift between: (a) a first position adjacent to the first inlet, wherein at the first position the movable member blocks the first inlet while connecting the second workport passage to the outlet through the second inlet, and (b) a second position adjacent to the second inlet, wherein at the second position the movable member blocks the second inlet while connecting the first workport passage to the outlet through the first inlet; and a relief valve disposed in the housing and connected to the outlet of the shuttle valve.

3. The valve section of claim 1, wherein the housing has a substantially planar surface, wherein the substantially planar surface includes a first opening connected to the open-center passage, a second opening connected to the first return passage, a third opening connected to the supply passage, and a fourth opening connected to the second return passage, and wherein respective centers of the second opening, the third opening, and the fourth opening are longitudinally aligned relative to each other, whereas a center of the first opening is transversely offset on the substantially planar surface relative to the respective centers of the second opening, the third opening, and the fourth opening.

4. The valve section of claim 1, wherein the housing has a substantially planar surface, the valve section further comprising:

a first guide pin coupled to and protruding from the substantially planar surface; and a second guide pin coupled to and protruding from the substantially planar surface, wherein the first and second guide pins are inserted into corresponding holes disposed in a respective housing of an adjacent valve section to align the valve section with the adjacent valve section while attaching the valve section to the adjacent valve section.

5. A valve assembly comprising:

a first end section having: (i) an inlet port configured to be fluidly coupled to a source of fluid, and (ii) a first outlet port configured to be fluidly coupled to a reservoir;

a second end section having a second outlet port configured to be fluidly coupled to the reservoir;

a plurality of valve sections positioned between the first end section and the second end section, wherein each valve section of the plurality of valve sections comprises:

a housing having: (i) a longitudinal bore, (ii) a first and second workport passages intercepting the longitudinal bore and configured to be fluidly coupled to an actuator, (iii) a first and second return passages intercepting the longitudinal bore and connected to the first outlet port and the second outlet port, (iv) an open-center passage intercepting the longitudinal bore and configured to be connected to the inlet port of the first end section, and (v) a supply passage intercepting the longitudinal bore, and a spool movable in the longitudinal bore to shift between: (i) a neutral position that allows the open-center passage to permit fluid flow from the inlet port through the open-center passage, and (ii) a shifted position that allows fluid to be diverted from the open-center passage to the supply passage, and connects the supply passage to either the first or second workport passage while connecting the other workport passage to a corresponding return passage of the first and second return passages;

a plurality of tie-bolts traversing the plurality of valve section to couple the plurality of valve sections to each other; and a mounting plate coupled to the first end section or the second end section, wherein at least one tie-bolt of the plurality of tie-bolts interfaces with the mounting plate via a compliant washer.

6. The valve assembly of claim 5, wherein the plurality of tie-bolts are made of a material that is different from a respective material of the housing.

7. The valve assembly of claim 5, wherein the compliant washer comprises a Belleville spring washer.

8. The valve assembly of claim 7, further comprising:

a jam nut configured to couple the at least one tie-bolt to the mounting plate, wherein the Belleville spring washer has a first side shaped as a crown and a second side that is flat, and wherein the first side shaped as a crown faces toward the jam nut.

9. The valve assembly of claim 8, further comprising:

a flat washer disposed at the second side of the Belleville spring washer.

10. The valve assembly of claim 7, further comprising:

a first flat washer disposed at a first side of the Belleville spring washer; and a second flat washer disposed at a second side of the Belleville spring washer, such that the Belleville spring washer is sandwiched between the first flat washer and the second flat washer.

11. The valve assembly of claim 5, wherein respective first return passages of the plurality of valve sections form a first return path, wherein respective second return passages of the plurality of valve sections form a second return path parallel to the first return path, wherein the first return path and the second return path are connected to each other and to the first outlet port via the first end section, and wherein the first return path and the second return path are connected to each other and to the second outlet port via the second end section.

12. The valve assembly of claim 5, wherein the first end section comprises a fluid diversion passage connecting the inlet port to the supply passage, wherein the shifted position allows fluid to be diverted from the open-center passage to the supply passage through the fluid diversion passage.

13. The valve assembly of claim 12, wherein the fluid diversion passage is blocked by a spring-loaded check valve that allows fluid to traverse the fluid diversion passage when pressure level of fluid received from the inlet port exceeds a predetermined threshold pressure.

14. The valve assembly of claim 5, wherein the actuator is a first actuator, wherein the housing further comprises:

a first port connected to the first workport passage, wherein the first port is configured to be fluidly coupled to a first chamber of the first actuator;

a second port connected to the second workport passage, wherein the second port is configured to be fluidly coupled to a second chamber of the first actuator, and wherein the first port and the second port are disposed on a given side of the housing and oriented in same direction;

a third port connected to the first workport passage, wherein the third port is configured to be fluidly coupled to a respective first chamber of a second actuator; and a fourth port connected to the second workport passage, wherein the fourth port is configured to be fluidly coupled to a respective second chamber of the second actuator, and wherein the third and fourth ports are disposed on the given side of the housing and oriented in the same direction as the first and second ports.

15. The valve assembly of claim 5, wherein at least one valve section of the plurality of valve sections further comprises:

a shuttle valve disposed in the housing and comprising: (i) a shuttle valve body defining a first shuttle inlet connected to the first workport passage, a second shuttle inlet connected to the second workport passage, and a shuttle outlet, wherein the second shuttle inlet is coaxial with, and mounted opposite to, the first shuttle inlet, and wherein the shuttle outlet is disposed transverse to the first and second shuttle inlets, and (ii) a movable member that is movable within the shuttle valve body to shift between: (a) a first position adjacent to the first shuttle inlet, wherein at the first position the movable member blocks the first shuttle inlet while connecting the second workport passage to the shuttle outlet through the second shuttle inlet, and (b) a second position adjacent to the second shuttle inlet, wherein at the second position the movable member blocks the second shuttle inlet while connecting the first workport passage to the shuttle outlet through the first shuttle inlet; and a relief valve disposed in the housing and connected to the shuttle outlet of the shuttle valve.

16. The valve assembly of claim 5, wherein the housing has a substantially planar surface, wherein the substantially planar surface includes a first opening connected to the open-center passage, a second opening connected to the first return passage, a third opening connected to the supply passage, and a fourth opening connected to the second return passage, and wherein respective centers of the second opening, the third opening, and the fourth opening are longitudinally aligned relative to each other, whereas a center of the first opening is transversely offset on the substantially planar surface relative to the respective centers of the second opening, the third opening, and the fourth opening.

17. The valve assembly of claim 5, wherein the spool is manually-movable by a handle coupled to the spool.

18. The valve assembly of claim 5, wherein at least one valve section of the plurality of valve sections comprises:

a first electrically-actuated pilot valve configured to provide pressurized fluid to a first end of the spool of the at least one valve section when actuated to move the spool in a first direction; and a second electrically-actuated pilot valve configured to provide pressurized fluid to a second end of the spool of the at least one valve section when actuated to move the spool in a second direction opposite the first direction, wherein the first and second electrically-actuated pilot valves are disposed in the housing of the at least one valve section parallel to each other on a given side of the housing and parallel to a longitudinal axis of the spool.

19. A hydraulic system comprising:

a hydraulic actuator having a first chamber and a second chamber;

a source of fluid;

a reservoir; and a valve assembly comprising: (i) a first end section having an inlet port configured to be fluidly coupled to the source of fluid and a first outlet port configured to be fluidly coupled to the reservoir, (ii) a second end section having a second outlet port configured to be fluidly coupled to the reservoir, and (iii) a plurality of valve sections positioned between the first end section and the second end section, wherein each valve section of the plurality of valve sections comprises:

a housing having a substantially planar surface, wherein the housing comprises:

(i) a longitudinal bore, (ii) a first and second workport passages intercepting the longitudinal bore and configured to be fluidly coupled respectively to the first and second chambers of the hydraulic actuator, (iii) a first and second return passages intercepting the longitudinal bore and connected to the first outlet port and the second outlet port, (iv) an open-center passage intercepting the longitudinal bore and configured to be connected to the inlet port, and (v) a supply passage intercepting the longitudinal bore, a spool movable in the longitudinal bore to shift between: (i) a neutral position that allows the open-center passage to permit fluid flow from the inlet port through the open-center passage, and (ii) a shifted position that allows fluid to be diverted from the open-center passage to the supply passage, and connects the supply passage to either the first or second workport passage while connecting the other workport passage to a corresponding return passage of the first and second return passages, a first guide pin coupled to and protruding from the substantially planar surface of the housing, and a second guide pin coupled to and protruding from the substantially planar surface of the housing, wherein the first and second guide pins are inserted into corresponding holes disposed in a respective housing of an adjacent valve section to align the valve section with the adjacent valve section while attaching the valve section to the adjacent valve section.

20. The hydraulic system of claim 19, wherein the hydraulic actuator is a first hydraulic actuator, wherein the hydraulic system includes a second hydraulic actuator having a third chamber and a fourth chamber, and wherein a respective housing of at least one valve section of the plurality of valve sections further comprises:

a first port connected to the first workport passage, wherein the first port is configured to be fluidly coupled to the first chamber of the first hydraulic actuator;

a second port connected to the second workport passage, wherein the second port is configured to be fluidly coupled to the second chamber of the first hydraulic actuator;

a third port connected to the first workport passage, wherein the third port is configured to be fluidly coupled to the third chamber of the second hydraulic actuator; and a fourth port connected to the second workport passage, wherein the fourth port is configured to be fluidly coupled to the fourth chamber of the second hydraulic actuator, wherein the first, second, third, and fourth ports are disposed on a given side of the respective housing and oriented in same direction.

* * * * *